US008469482B2

(12) United States Patent
Pawlik et al.

(10) Patent No.: US 8,469,482 B2
(45) Date of Patent: Jun. 25, 2013

(54) METHOD FOR DETERMINING VARIANCE OF INKJET SENSOR

(75) Inventors: Thomas D. Pawlik, Rochester, NY (US); Mark C. Rzadca, Fairport, NY (US); Thomas F. Powers, Webster, NY (US)

(73) Assignee: Eastman Kodak Company, Rochester, NJ (US)

( * ) Notice: Subject to any disclaimer, the term of this patent is extended or adjusted under 35 U.S.C. 154(b) by 126 days.

(21) Appl. No.: 13/118,782

(22) Filed: May 31, 2011

(65) Prior Publication Data

US 2012/0306957 A1 Dec. 6, 2012

(51) Int. Cl.
*B41J 29/393* (2006.01)

(52) U.S. Cl.
USPC ..... 347/19; 347/14; 347/16; 347/101

(58) Field of Classification Search
USPC ..... 347/14, 16, 19, 105–107
See application file for complete search history.

(56) References Cited

U.S. PATENT DOCUMENTS

| | | | |
|---|---|---|---|
| 5,139,339 A | 8/1992 | Courtney et al. | |
| 6,386,669 B1 | 5/2002 | Scofield et al. | |
| 6,561,643 B1 | 5/2003 | Walker et al. | |
| 6,713,775 B2 * | 3/2004 | Chelvayohan et al. | 347/14 |
| 6,914,684 B1 | 7/2005 | Bolash et al. | |

* cited by examiner

*Primary Examiner* — Juanita D Jackson
(74) *Attorney, Agent, or Firm* — Peyton C. Watkins

(57) ABSTRACT

A method for determining a variance of a sensor in inkjet printers includes maintaining a printer carriage at a stationary position; illuminating a media patch of known characteristics with a light source that varies an intensity of the light between at least a first and second intensity, in which the second intensity is different from the first intensity; obtaining at least specular reflectance data from light reflected off the print media by measuring a signal from a photo-detector during the illumination; and comparing the specular data to stored values to determine a variation of the sensor response for forming a correction factor; and using the correction factor to calibrate at least a first signal of the inkjet printer.

15 Claims, 10 Drawing Sheets

METHOD FOR DETERMINING VARIANCE OF INKJET SENSOR

CROSS REFERENCE TO RELATED APPLICATIONS

Reference is made to commonly assigned U.S. patent application Ser. No. 13/118,788 filed May 31, 2011 by Thomas D. Pawlik et al., entitled "An Inkjet Printer Having Automated Calibration", and commonly assigned U.S. patent application Ser. No. 13/118,805 filed May 31, 2011 by Thomas D. Pawlik et al., entitled "A Method For Adjusting A Sensor Response", the disclosures of which are herein incorporated by reference.

FIELD OF THE INVENTION

The present invention generally relates to inkjet printers having a sensor that illuminates the print media and receives reflected light data for determining print media type, and more particularly a method for obtaining calibration data for the sensor due to light intensity variations that occur over time.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge, so that the printhead needs to be replaced when the ink is depleted, or the ink tank can be detachably mounted to the printhead so that only the ink tank itself needs to be replaced when the ink tank is depleted. Carriage mounted ink supplies typically contain only enough ink for up to about several hundred prints. This is because the total mass of the carriage needs be limited so that accelerations of the carriage at each end of the travel do not result in large forces that can shake the printer back and forth.

Pickup rollers are used to advance the media from its holding tray along a transport path towards a print zone beneath the carriage printer where the ink is projected onto the media. In the print zone, ink droplets are ejected onto the media according to corresponding printing data.

It is noted that consumers use a plurality of different types of media for printing in inkjet printers. Commonly assigned and pending U.S. application Ser. No. 12/959,461 filed Dec. 3, 2010 uses a sensor having a light source and detector for detecting the type of media being used for printing. As with any light source, light intensity may vary slightly over time causing the resulting signal used for detecting the media type to correspondingly vary.

Although the currently used apparatuses and methods for detecting the media type are sufficient, there exists a need to detect such light variations and calibrate the photo-detector signal accordingly for permitting accurate detection of media type. Consequently, the present invention provides a method for detecting the light variation and providing a calibration signal.

SUMMARY OF THE INVENTION

The present invention is directed to overcoming one or more of the problems set forth above. Briefly summarized, according to one aspect of the invention, the invention resides in a method for determining a variance of a sensor in inkjet printers comprising maintaining a printer carriage at a stationary position; illuminating a media patch of known characteristics with a light source that varies an intensity of the light between at least a first and second intensity, in which the second intensity is different from the first intensity; obtaining at least specular reflectance data from light reflected off the print media by measuring a signal from a photo-detector during the illumination; and comparing the specular data to stored values to determine a variation of the sensor response for forming a correction factor; and using the correction factor to calibrate at least a first signal of the inkjet printer.

These and other objects, features, and advantages of the present invention will become apparent to those skilled in the art upon a reading of the following detailed description when taken in conjunction with the drawings wherein there is shown and described an illustrative embodiment of the invention.

ADVANTAGEOUS EFFECT OF THE INVENTION

The present invention has the advantage of combining an optical surface texture measurement that is conducted with high amplification by using an AC-coupled amplifier, with a measurement of specular and diffuse reflectivity that is conducted using a modulation scheme. The modulation produces an alternating signal at the output of the AC-coupled amplifier whose amplitude is proportional to the specular and diffuse reflectivity of the surface tested. This added information allows detection of sensor degradation. If the test surface is the print side of the media, a comparison of specular and diffuse reflectance also provides information in addition to the surface scan that helps to determine the type of media.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Before discussing the present invention, it is useful to have a clear understanding of the terms used herein. As used herein, high and low intensity light pulses are defined as being on the high and low intensity side of a nominal light intensity (In) and given by the formula (In+ΔIn) for the high intensity light pulse and (In−ΔIn) for the low intensity light pulse, where ΔIn is preferably 1-10 percent although other ΔIn may also be used. It should be noted that although the term light is used herein, it is meant to also include electromagnetic radiation outside the visible spectrum.

Figure 1:
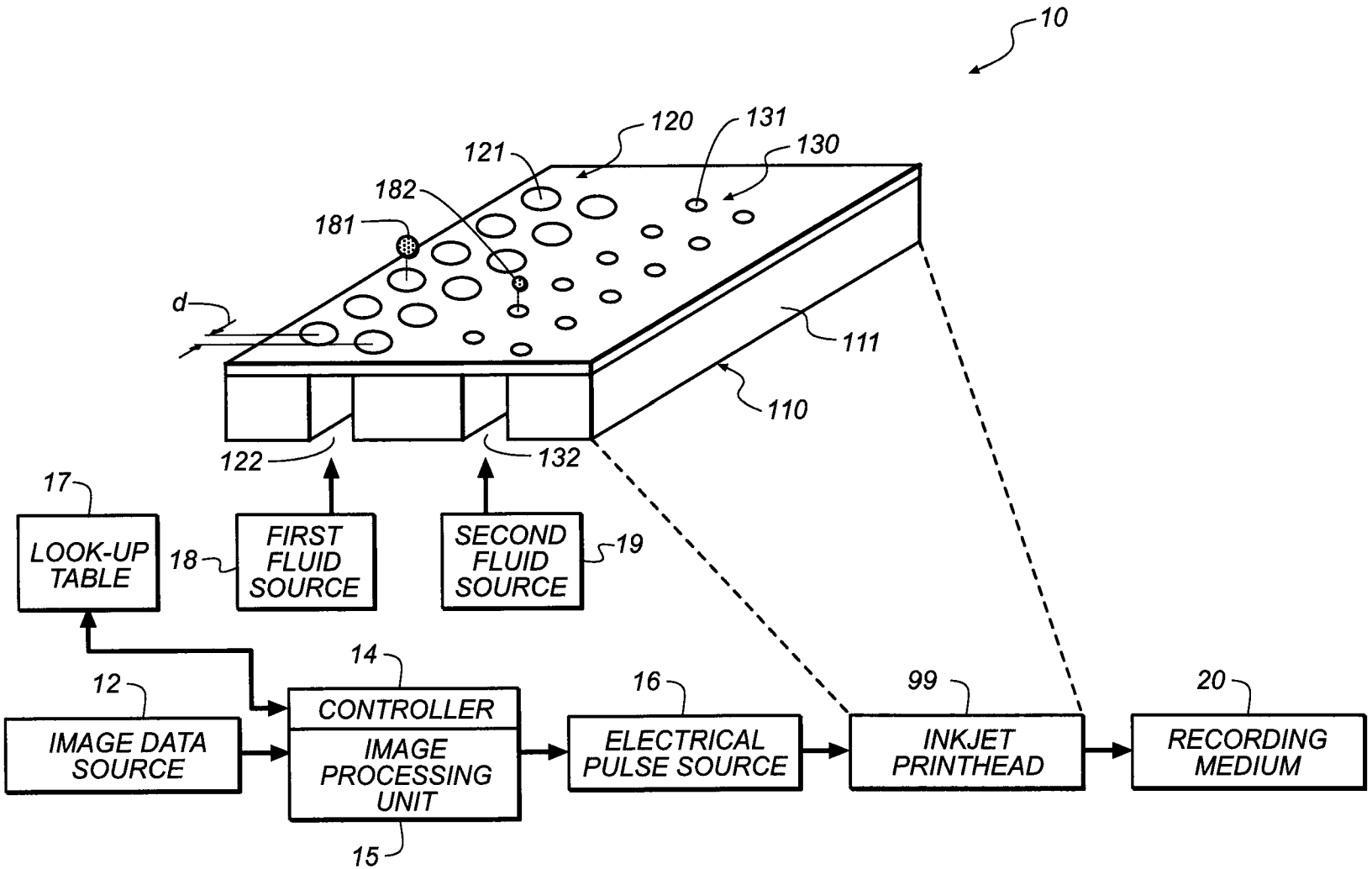
FIG. 1 is a schematic representation of an inkjet printer system.

Referring to FIG. 1, a schematic representation of an inkjet printer system 10 is shown for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and the controller 14 outputs signals to an electrical pulse source 16 of electrical energy pulses that are inputted to an inkjet printhead 99, which includes at least one inkjet printhead die 110. A look-up table 17 includes bi-directional communication with the controller 14 that is used in determining media type as described in U.S. Pat. No. 7,635,853 and will not be further discussed herein.

In the example shown in FIG. 1, there are two nozzle arrays.

Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the media advance direction, the nozzles from one row of an array would print the odd numbered pixels, and the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 99, but for greater clarity only one inkjet printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
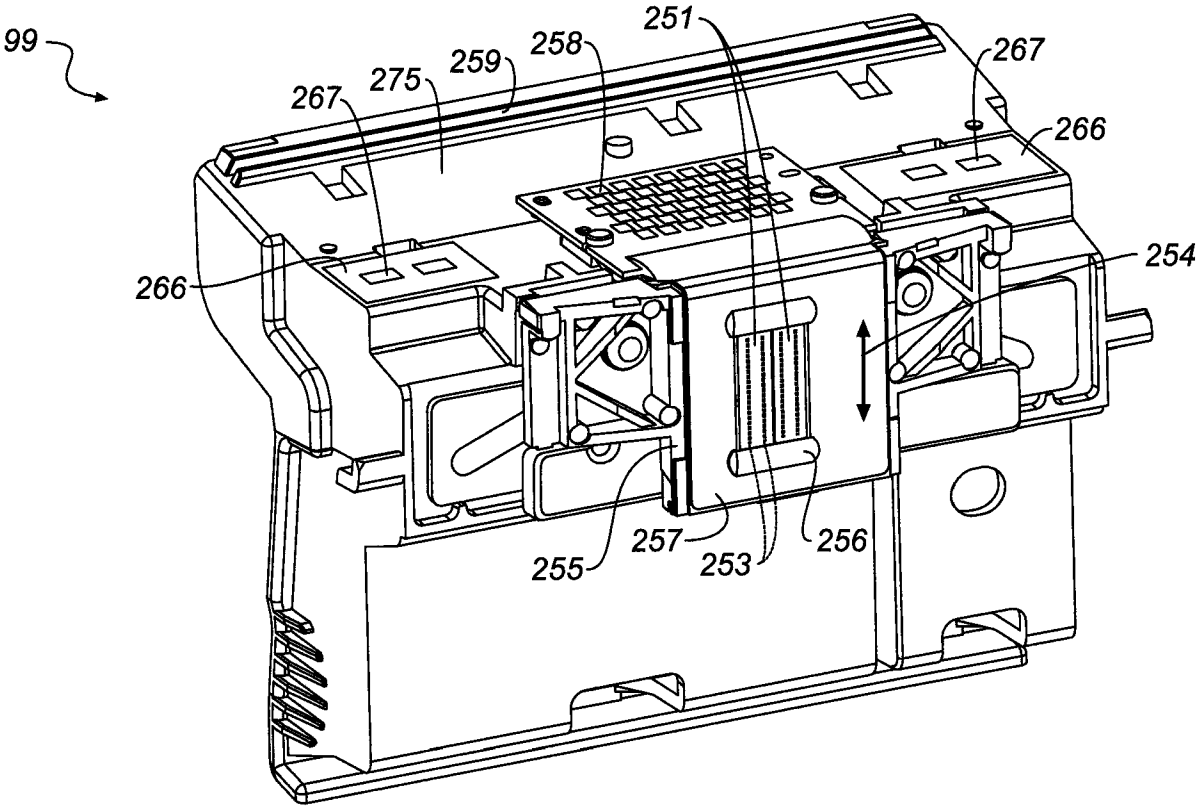
FIG. 2 is a perspective view of a portion of a printhead.

FIG. 2 shows a perspective view of the inkjet printhead 99 plus ink sources 18 and 19. Inkjet printhead 99 includes two printhead die 251 (similar to printhead die 110 in FIG. 1) that are affixed to mounting substrate 255. Each printhead die 251 contains two nozzle arrays 253 so that inkjet printhead 99 contains four nozzle arrays 253 altogether. The four nozzle arrays 253 in this example are each connected to ink sources (not shown in FIG. 2), such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for plain paper (8.5 by 11 inches). Thus, in order to print a full image, a number of swaths are successively printed while moving inkjet printhead 99 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of inkjet printhead 99 and connects to connector board 258 on rear wall 275. A lip 259 on rear wall 275 serves as a catch for latching inkjet printhead 99 into the carriage 200. When inkjet printhead 99 is mounted into the carriage 200 (see FIG. 3), connector board 258 is electrically connected to a connector on the carriage 200 so that electrical signals can be transmitted to the printhead die 251. Inkjet printhead 99 also includes two devices 266 mounted on rear wall 275. When inkjet printhead 99 is properly installed into the carriage of a carriage printer, electrical contacts 267 will make contact with an electrical connector on the carriage.

Figure 3:
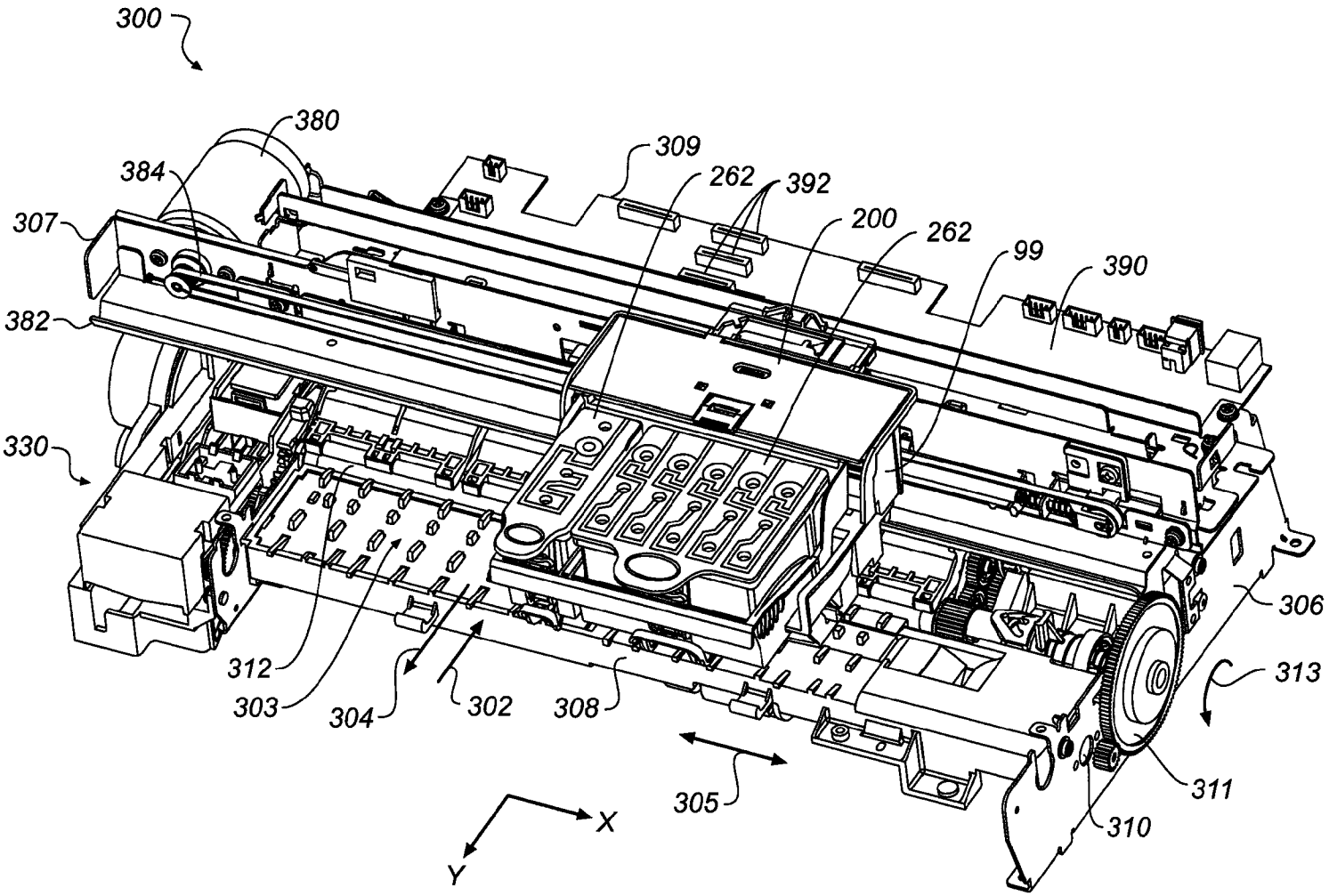
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 between the right side 306 and the left side 307 of printer chassis 300, while drops are ejected from printhead die 251 (not shown in FIG. 3) on inkjet printhead 99 that is mounted on carriage 200. Carriage motor 380 moves belt 384 to move carriage 200 along carriage guide rail 382.

The mounting orientation of inkjet printhead 99 is rotated relative to the view in FIG. 2, so that the printhead die 251 are located at the bottom side of inkjet printhead 99, the droplets of ink being ejected downward onto the recording medium in print region 303 in the view of FIG. 3. Cyan, magenta, yellow and black ink sources 262 are integrated into inkjet printhead 99. Paper or other recording medium (sometimes generically referred to as paper or media herein) is loaded along paper load entry direction 302 toward the front of printer chassis 308.

Figure 4:
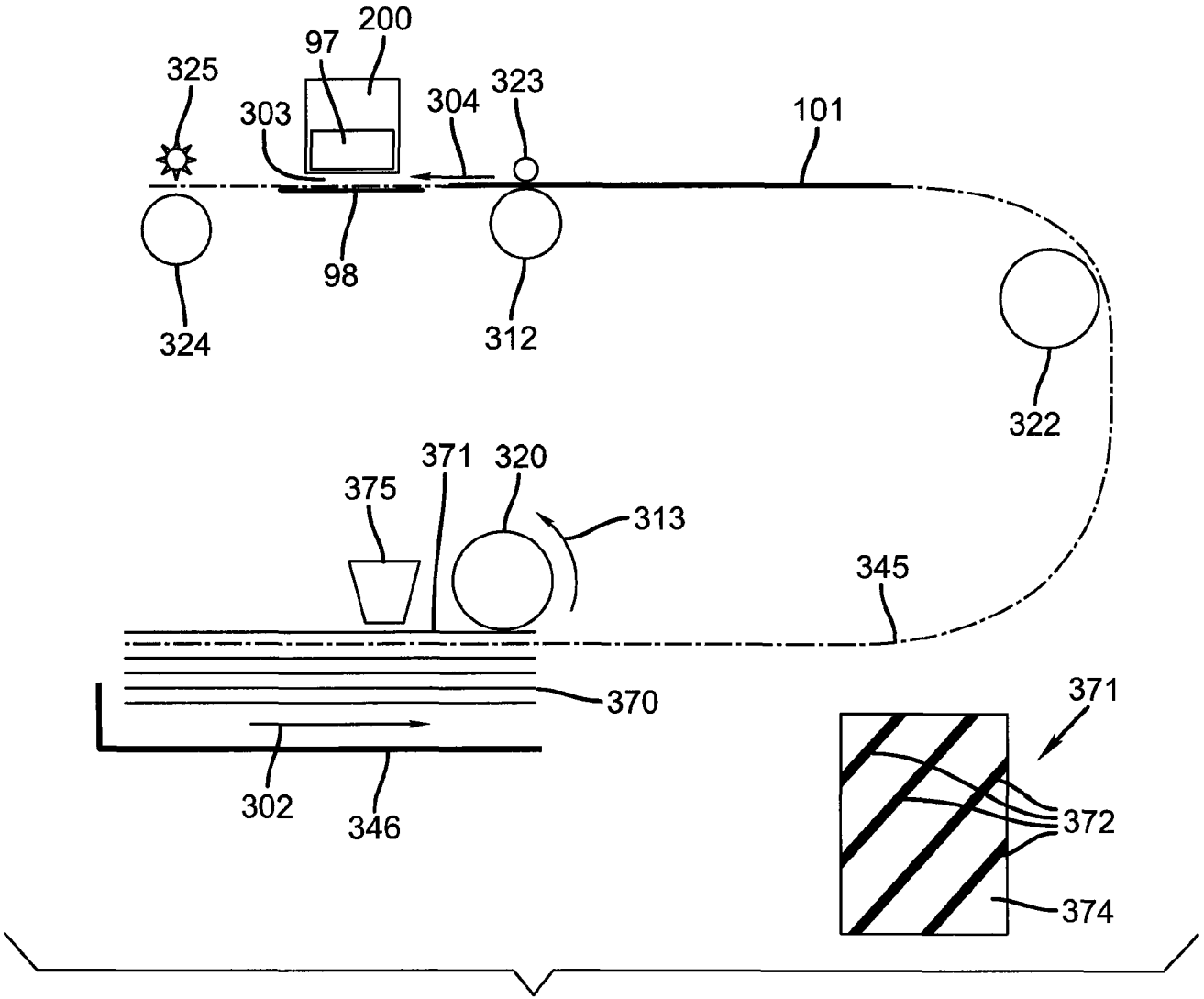
FIG. 4 is a schematic side view of a media path in a carriage printer of the present invention.

A variety of rollers are used to advance the medium through the media transport path 345 (indicated by the dot dash lines) of the printer as shown schematically in the side view of FIG. 4. In this example, a pick-up roller 320 moves the top sheet of the media 371 (referred to as recording medium 20 in FIG. 1) of the stack of media 370 in the direction of arrow, media load entry direction 302, from the input tray 346. A turn roller 322 acts to move the media around a C-shaped path (in cooperation with a curved rear wall surface) so that the media 371 continues to advance along media advance direction 304 from the rear 309 of the printer chassis (with reference also to FIG. 3). The media 371 is then moved by feed roller 312 and idler roller(s) 323 to advance across print region 303, and from there to a discharge roller 324 and star wheel(s) 325 so that printed media exits along media advance direction 304. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft.

The motor that powers the media advance rollers is not shown in FIG. 3, but the hole 310 at the printer chassis right-side 306 is where the motor gear (not shown) protrudes through in order to engage feed roller gear 311, as well as the gear for the discharge roller (not shown). For normal media pick-up and feeding, it is desired that all rollers rotate in forward rotation direction 313. Toward the printer chassis left-side 307, in the example of FIG. 3, is the maintenance station 330.

Toward the printer chassis rear 309, in this example, there is located the electronics board 390, which includes cable connectors 392 for communicating via cables (not shown) to the printhead carriage 200 and from there to the inkjet printhead 99. Also on the electronics board are typically mounted motor controllers for the carriage motor 380 and for the media advance motor, a processor and/or other control electronics (shown schematically as controller 14 and image processing unit 15 in FIG. 1) for controlling the printing process, and an optional connector for a cable to a host computer.

Referring to FIG. 4, the printhead carriage 200 includes a reflectance sensor 97 having a light source and photo-detector. Movement of the printhead carriage 200 by the carriage motor 300 and belt 304 simultaneously moves the attached reflectance sensor 97 in a direction perpendicular to the media feed direction.

The reflectance sensor uses the print side 101 (i.e, the side of the media on which printing occurs) of the media 371 to identify the particular type of media currently being used for printing as disclosed in U.S. Pat. No. 7,635,853. An additional barcode sensor 375 detects a barcode 372 on the non-print side of the media 374. It is noted that the printer uses any of a plurality of media types for printing (matte, plain or glossy), and the printer identifies the particular type of media being used so that corresponding printing adjustments can be made.

The optical components of the reflectance sensor 97 are subject to manufacturing tolerances. This necessitates an initial calibration. In addition, over time the light source or photodetector may become degraded so that the corresponding signal from the reflectance sensor 97 varies from the signal present when the sensor was initially configured. The degradation can be due to aging of the optoelectronic components or deposition of ink spray. In addition to identifying the media type, the reflectance sensor 97 of the present invention is used to detect variations in the signal from the light source and photo-detector system that may occur over time.

An optional media patch 98 of known characteristics (typically either matte or glossy) is placed in a location suitable for the reflectance sensor 97 to optically illuminate and capture the reflected light. For example, the reflectance sensor 97 may be located to the side of the printhead carriage 200 and the media patch may be located in the print region 303 at a position slightly below the media plane such that it can be illuminated by the reflectance sensor prior to media pick-up and feeding to the print zone as shown in FIG. 4. Alternatively, the media patch 98 can be located in plane with the media but to either side of the print region 303, i.e., outside of the footprint of the media. This media patch 98 is used in certain embodiments to determine whether there is degradation of the reflectance sensor 97 as described herein below.

Figure 5:
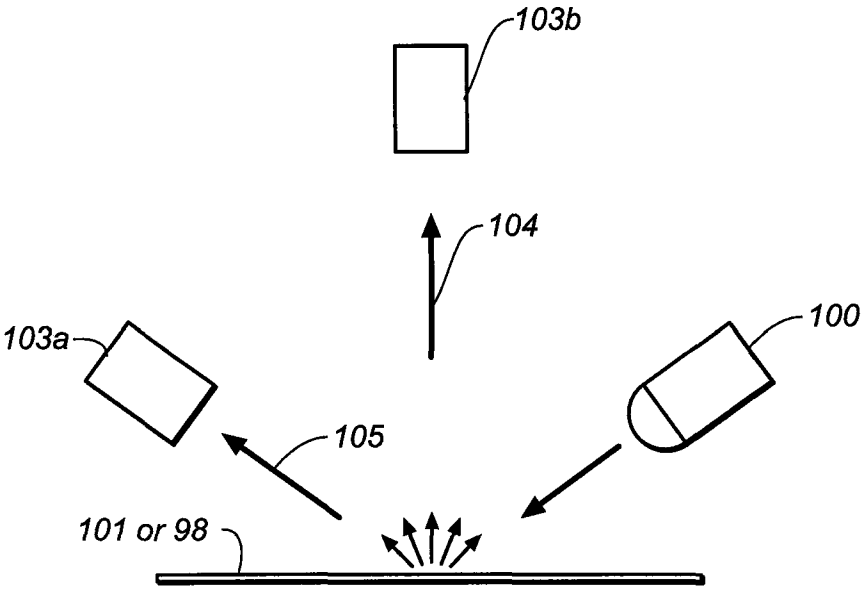
FIG. 5 is a block diagram illustrating the components of the print side reflectance sensor.

Referring to FIG. 5, there is shown an embodiment of the reflectance sensor 97. As the printhead carriage 200 is maintained in a stationary position, the illumination source 100 emits a sequence of light pulses onto the print side of the media 101, or alternatively onto the media patch 98. Preferably a low intensity light pulse ($I_0-\Delta I_0$) is emitted first, immediately followed by a high intensity light pulse ($I_0+\Delta I_0$). This sequence is preferably repeated a number of times so that sufficient data points are collected although one sequence may also be used for time efficiency. The repeat frequency is chosen high enough such that the time variant signal is amplified by the AC-coupled amplifier. Preferably the repeat frequency is at or above the −3 dB point of the high pass filter circuit of the AC coupled amplifier. Although the present invention uses a low intensity light pulse followed by a high intensity light pulse, a high intensity pulse may be emitted first followed by a low intensity light pulse.

The photo-detector 103*a* detects specular reflections, and the detector 103*b* detects diffuse reflections. The signals from detector 103*a* and 103*b* are then used by the controller 14 to determine specular and diffuse reflectivity of the print media 101, or alternatively the media patch 98.

Following the detection of the light pulses, the illumination source 100 is set to emit constant light of the intensity $I_0'$ and the printer carriage 200 is moved across the media in the direction perpendicular to the media advance direction. During the printer carriage motion, the signal from at least one of the two photodetectors is recorded by the controller 14.

Figure 6:
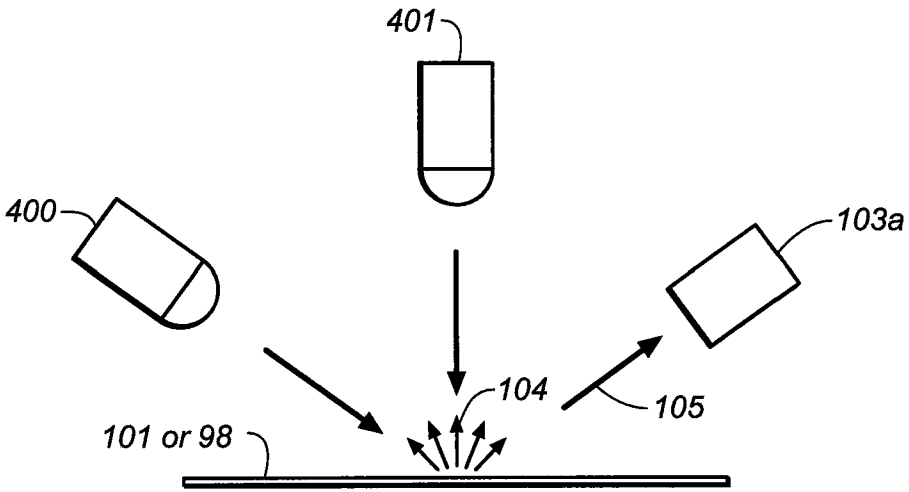
FIG. 6 is also a block diagram illustrating a second embodiment of FIG. 5.
Figure 7:
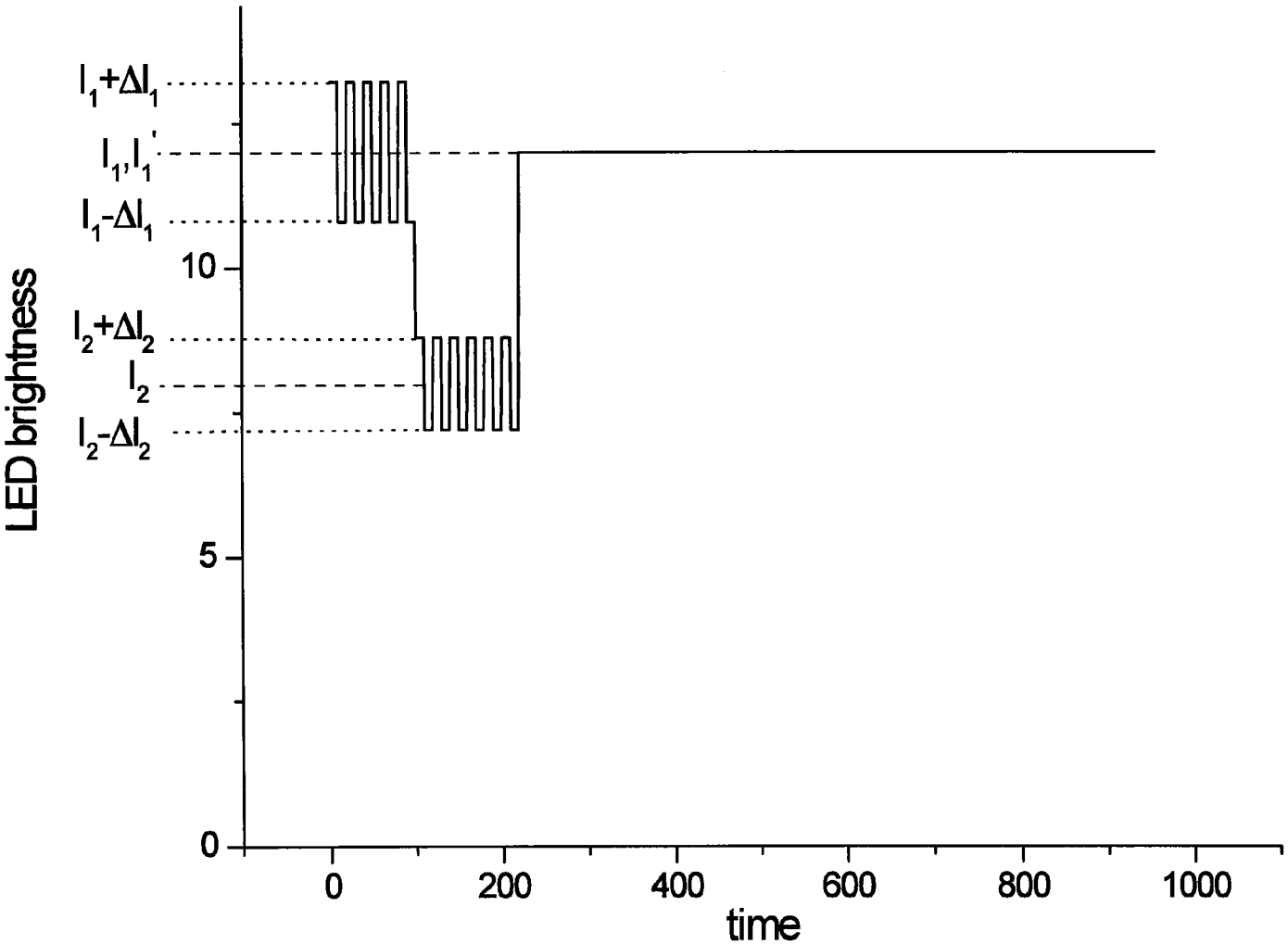
FIG. 7 shows a simulated trace of the time-varying intensity values of the illumination sources.

Referring to FIG. 6, there is shown an alternative embodiment of the present invention. In this embodiment, there are two light sources 400 and 401 that illuminate the print side of the media 101 or alternatively the media patch 98 and one photodetector 103*a* that captures reflected light. The light sources 400 and 401 are positioned so that the reflected light captured by the photodetector 103*a* and originating from source 401 is diffuse and the reflected light captured by the photodetector 103*a* and originating from the source 400 is specular. As the printer carriage 200 is maintained in a stationary position, the illumination source emits a sequence of high and low light pulses onto the media 101 or media patch 98 while the illumination source 401 is off. Subsequently, the illumination source 401 emits a sequence of high and low light pulses onto the media 101 or media patch 98 while the illumination source 400 is off. Referring to FIG. 7, each pulse sequence consists of alternating intensities of $(I_1+\Delta I_1)$ and $(I_1-\Delta I_1)$ for illumination source 400 and alternating intensities of $(I_2+\Delta I_2)$ and $(I_2-\Delta I_2)$ for illumination source 401. These light pulses are detected by the photodetector 103*a*. It should be obvious to a person skilled in the art that a light source intensity can be regulated by changing the current, or by changing the duty cycle using high frequency pulse width modulation. Although not preferred in this invention, light intensity modulation by a mechanical or photoelectric modulator is also possible.

Following the detection of the light pulses, the illumination source 400 emits a constant light of the intensity $I_1$ while illumination source 401 is switched off and the printhead is simultaneously moved at a constant velocity across the media in the direction perpendicular to the media advance direction. During the printhead motion, the signal from the photodetector is recorded by the controller 14.

Both sensor configurations in FIGS. 5 and 6 are able to measure specular and diffuse reflectivity of the print side of the media 101 or media patch 98 during the phase in which the illumination intensity is modulated and the printhead carriage 200 is not moving. They are further able to measure media surface texture during the phase in which the illumination intensity is constant and the printhead carriage 200 is moving at a constant velocity. The following FIGS. 8-10 describe how this data is used to improve robustness of media detection.

Figure 8:
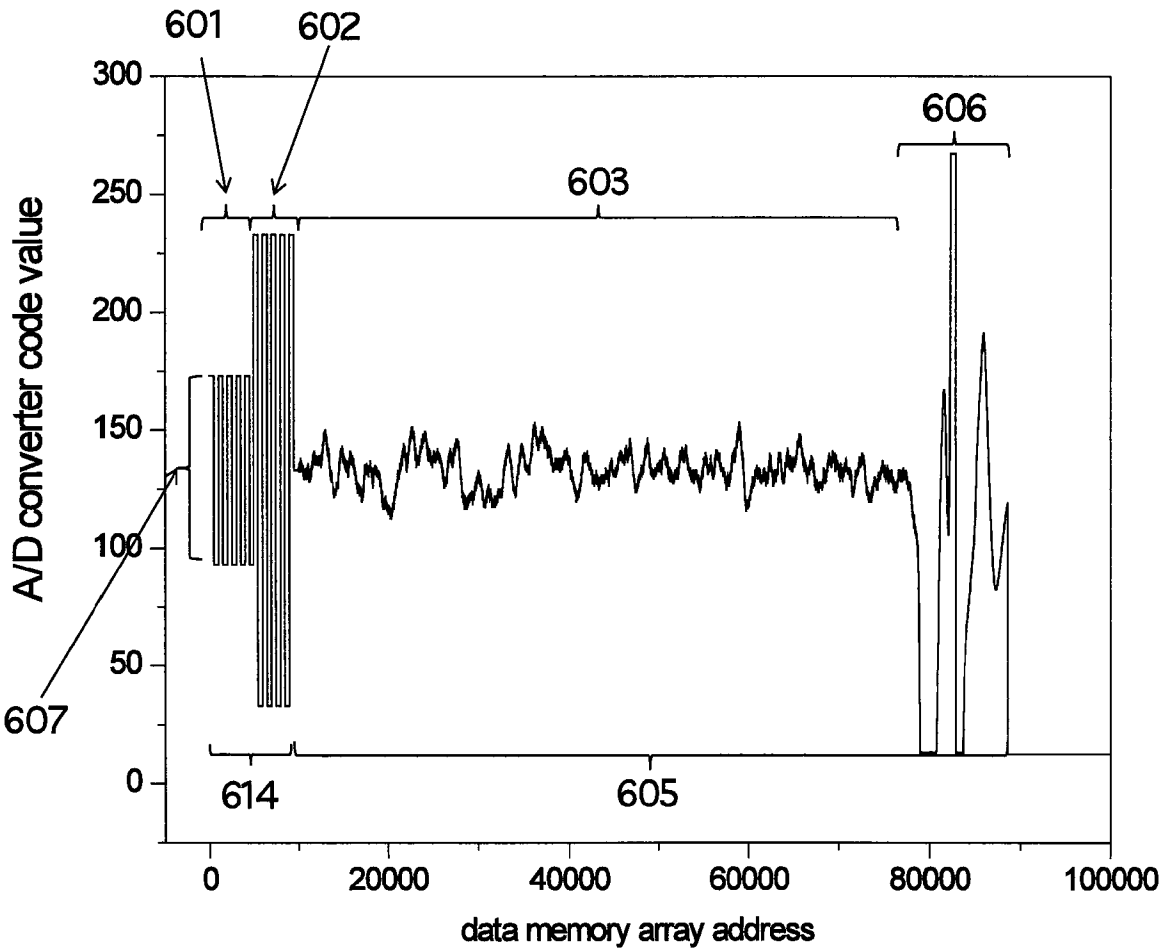
FIG. 8 shows a simulated trace from the sensor in FIG. 6 including the phases of reflectance measurement on a media patch and surface scan on the print side of the media.

Referring to FIG. 8, there is shown simulated data from the detectors of sensor 97 described in FIG. 5 using the media patch 98. The signals from the detectors are processed through an analog to digital converter for producing a digital signal which is a more suitable form for analysis. While the printer carriage is stationary in phase 604, the signal is monitored and it produces two distinct segments of data: the first region 601 is from specular light and the second region 602 is from diffuse light. The amplitude 607 of the specular reflectance signal (601) is compared by the controller 14 to stored target values for the media type identical to the media patch 98 which are stored in look-up table 17 (see FIG. 1). If the signal varies from the original signal target value, this indicates a degradation of the sensor 97, and the signal for identifying media type is then amplified or attenuated by the percent of the detected variance increase. If no difference is detected, the actual signal is used without any amplification or attenuation. Amplification or attenuation can be achieved by several methods. These include modification of the AC amplifier gain, adjustment of the light source intensity, mathematical processing of the digitized sensor signal or processing of the parameters derived from it by multiplication with a calibration factor. The result is a sensor signal that is compensated for degradation effects and represents a normalized sensor response.

The next region of the chart, 603, is the signal while the printhead is moving across the media surface (phase 605) and eventually encounters the edge of the media in phase 606. The microcontroller 14 analyzes the high frequency components of the recorded specular photodetector signal 603 after normalization by calculating amplitudes at several frequencies. These high frequency variations are caused by the surface texture of the front side of the media and are characteristically different for different media surface textures such as glossy and matte media. They can either be derived from the normalized photodetector signal 603 or from the direct photodetector signal. In the latter case the normalization is applied to the detected frequency amplitudes via a calibration factor. U.S. Pat. No. 7,635,853 discloses a method to compare these high frequency amplitudes to predetermined values and assign a media type when these amplitudes fall within certain limits. It is used in particular to distinguish between glossy photopaper and matte photopaper or plain paper. The present invention improves the robustness of the media detection by including a calibration step that compensates for sensor degradation. The diffuse reflectance signal, which can be calibrated in a similar manner, is not used for media detection in this example. It is used in the printer operation for the detection of the media edge.

Figure 9:
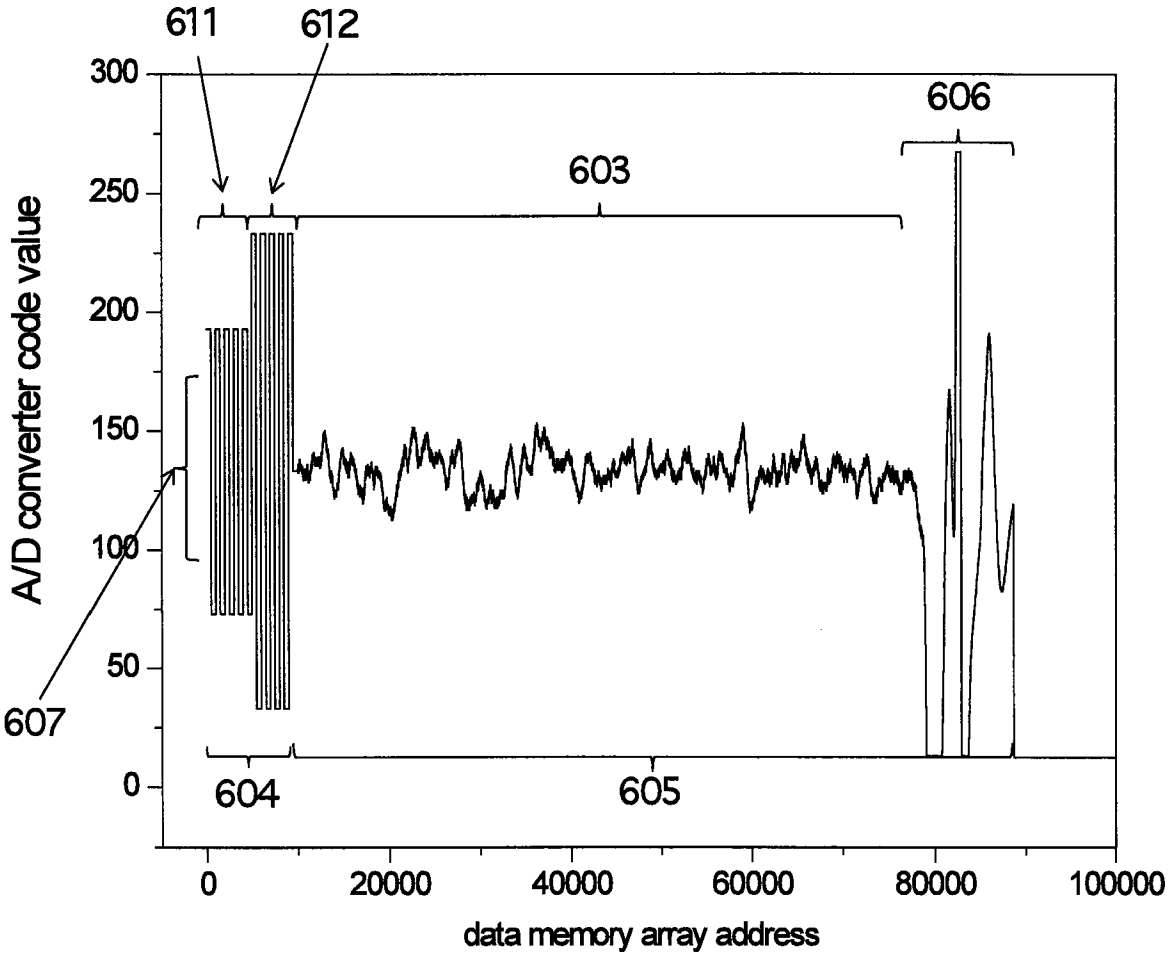
FIG. 9 shows a second embodiment of FIG. 8 where the reflectance measurement and surface scan are both performed on the print side of the media.

Referring to FIG. 9, there is shown simulated data from the detectors described hereinabove in FIG. 5 using the print side of the media 101. This data includes all the same descriptions as for FIG. 8, but it is noted that both the specular reflectance 611 and the diffuse reflectance 612 are obtained with the sensor 97 facing the print side of the media 101. The diffuse reflectance signal 612 is compared to a stored value for a predetermined surface. From the deviation, a calibration factor is obtained analogous to FIG. 8 and it is used to normalize sensor responses from both specular and diffuse reflectance. In addition, the normalized signal of the specular reflectance 611 carries information about the degree of gloss of the media surface. The sensor signal 611 will be higher for a glossy photo paper than for a matte photopaper or plain paper. This information is combined with information derived from the surface texture measurement 603 in a decision table algorithm that determines the media type. A special implementation of the calibration routine is possible if the media type is known prior to the execution of the calibration measurement, for example because of the detection of a barcode 372 by the barcode sensor 375, or because of pre-selection by the user from a list of media types. In this situation, the calibration algorithm can compare the measured specular and diffuse reflectance values to stored values for the pre-identified media type. A deviation of the measured reflectance values from the stored values indicates degradation of the sensor. Calibration factors can be obtained to normalize sensor response for future media detection events. This scenario can be described as periodic recalibration using known media properties.

Figure 10:
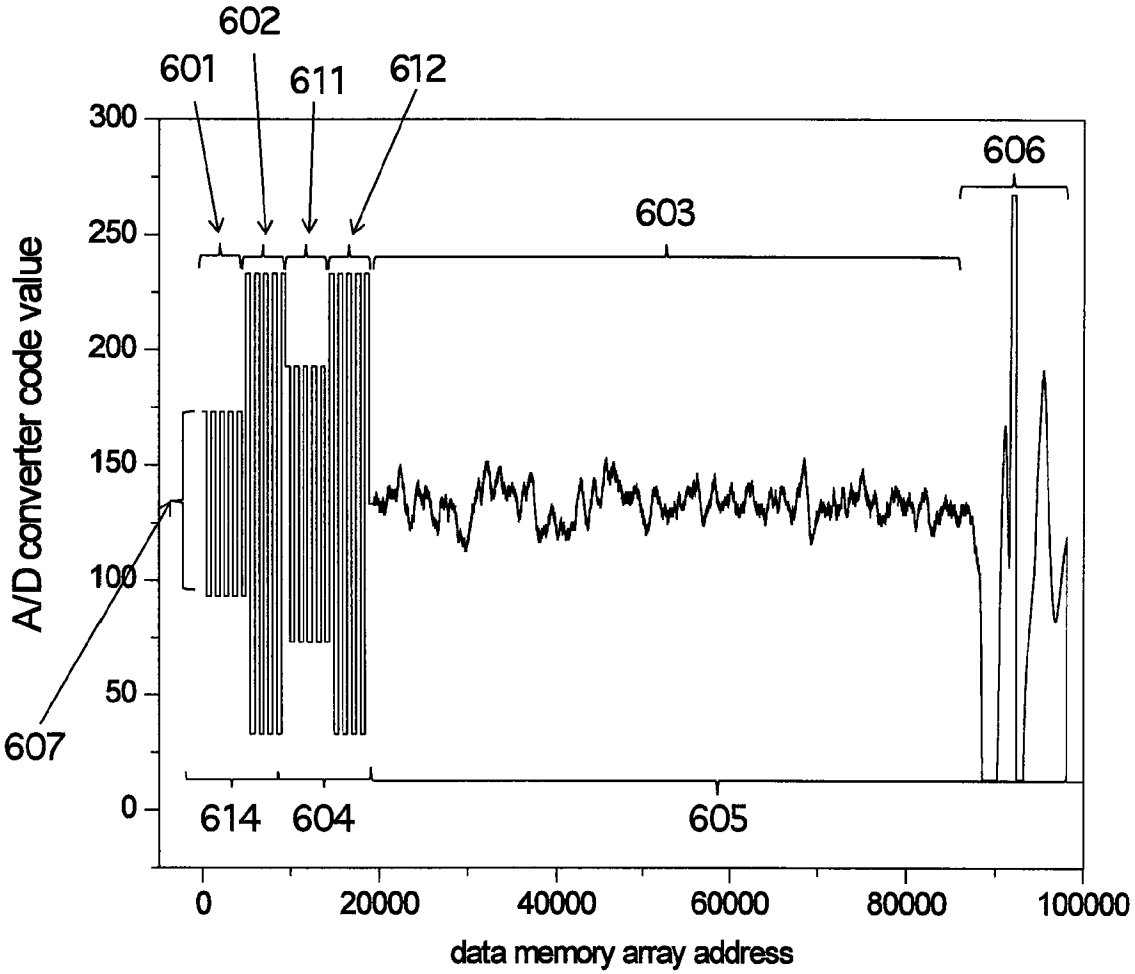
FIG. 10 shows a third embodiment of FIG. 8 where the reflectance measurement is performed on both the media patch and the print side of the media.

Referring to FIG. 10, there is shown simulated data from the detector 103*a* of FIG. 6. This measurement sequence combines a specular and diffuse reflectance measurement of the surface with known reflectivity 98 with a specular and diffuse reflectance measurement of the print side of the media

101. During the time period when the printer carriage is stationary 604 and the sensor is facing a surface of known reflectivity 98, light source 400 is pulsed using high and low intensity light pulses (while light source 401 is off) which creates specular reflectance 601. Then light source 401 is pulsed using high and low intensity light pulses (while light source 400 is off) which creates diffuse reflectance 602. The sensor signals during phases 601 and 602 are compared to stored values for the target of known reflectance. The variance is used to amplify or attenuate sensor response according to the process described in FIG. 8. Thus creating a normalized sensor response. Subsequently, the printhead carriage is moved to a position where the sensor 97 faces the print side of the media 101. During another stationary phase 614, the light source 400 is pulsed using high and low intensity light pulses (while light source 401 is off) which creates specular reflectance 611. Then light source 401 is pulsed using high and low intensity light pulses (while light source 400 is off) which creates diffuse reflectance 612. The normalized sensor signals during phases 611 and 612 are compared to predicted values for glossy photopaper, matte photopaper and plain paper. This comparison yields a predicted first media type from the reflectance measurement. Subsequently, the sensor is moved across the media surface in phase 605 and the high frequency components of the normalized specular reflectance signal are recorded and analyzed by the controller 14 analogous to the process in FIG. 8. This analysis yields a second media type. The final media type determination is made in a decision tree algorithm that uses the first and second media type as input.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
17 Look-up table
18 First ink source
19 Second ink source
20 Recording medium
97 Reflectance sensor
98 Media patch
99 Inkjet printhead
100 Illumination source
101 Media, print side
103*a* and 103*b* Photodetector
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
251 Printhead die
253 Nozzle array
254 Nozzle array direction
255 Mounting substrate
256 Encapsulant
257 Flex circuit
258 Connector board
259 Lip
262 Ink sources
266 Device
267 Electrical contact
275 Rear Wall
300 Printer chassis
302 Media load entry direction
303 Print region
304 Media advance direction
305 Carriage scan direction
306 Right side of printer chassis
307 Left side of printer chassis
308 Front of printer chassis
309 Rear of printer chassis
310 Hole (for media advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
345 Media transport path
346 Media tray
370 Stack of media
371 Top sheet of media
372 Barcode
374 Non-print side of media
375 Barcode sensor
380 Carriage motor
382 Carriage guide rail
384 Belt
390 Printer electronics board
392 Cable connectors
400 Illumination source source 1
401 Illumination source source 2
601 Specular Light—LED 400 is modulated between two brightness levels ($I1-\Delta I1 \leftrightarrow I1+\Delta I1$) for n periods, LED 401 is off. Sensor 97 is facing a a media patch 98
602 Diffuse Light—LED 401 is modulated between two brightness levels ($I2-\Delta I2 \leftrightarrow I2+\Delta I2$) for n periods, LED 400 is off. Sensor 97 is facing a a media patch 98
603 LED 400 is set at brightness pwm, LED 401 is off
604 Sensor is at a position facing a target of known reflectivity 98 and not moving
605 Sensor is moving across the front side of the media at a constant velocity using carriage motion
606 Sensor is past the media edge
607 Amplitude of the sensor response to the modulation scheme
611 Specular Light—LED 400 is modulated between two brightness levels ($I1-\Delta I1 \leftrightarrow I1+\Delta I1$) for n periods, LED 401 is off. Sensor 97 is facing the print side of the media 101
612 Diffuse Light—LED 401 is modulated between two brightness levels ($I2-\Delta I2 \leftrightarrow I2+\Delta I2$) for n periods, LED 400 is off. Sensor 97 is facing the print side of the media 101
614 Sensor is at a position facing the front side of the media 101 and not moving

The invention claimed is:

1. A method for determining a variance of a sensor in inkjet printers comprising:

maintaining a printer carriage at a stationary position;

illuminating a media patch of known characteristics with a light source that varies an intensity of the light between at least a first and second intensity, in which the second intensity is different from the first intensity;

obtaining at least specular reflectance data from light reflected off the media patch by measuring a signal from a photo-detector during the illumination; and comparing the specular data to stored values to determine a variation of the sensor response for forming a correction factor;

using the correction factor to calibrate at least a first signal of the inkjet printer;

obtaining diffuse reflectance and comparing the diffuse data to stored values to determine a variation of the sensor response for forming a correction factor;

using the correction factor to calibrate at least a second signal of the inkjet printer; and using the calibrated signal to execute a scan for media edge detection.

2. The method as in claim 1 further comprising using the calibrated signal to execute an optical surface texture measurement of a print media.

3. The method as in claim 2 further comprising determining the media type by analyzing the surface texture data.

4. The method as in claim 1, wherein the first intensity is a high intensity pulse and the second intensity is a low intensity pulse.

5. A method for determining a variance of a sensor in inkjet printers comprising:

maintaining a printer carriage at a stationary position;

illuminating a media with a light source that varies an intensity of the light between at least a first and second intensity, in which the second intensity is different from the first intensity; wherein the first and second intensities are provided by the same light source;

obtaining diffuse reflectance data from light reflected off the media by measuring a signal from a photo-detector during the illumination;

comparing the diffuse data to stored values to determine a variation of the sensor response for forming a correction factor; and using the correction factor to calibrate specular and diffuse signals of the sensor of the inkjet printer.

6. The method as in claim 5 further comprising obtaining calibrated specular reflectance data from the sensor and comparing the specular and diffuse reflectance data from the sensor to stored values for glossy and matte media to derive a predicted media type.

7. The method as in claim 6 further comprising using the calibrated specular signal to execute an optical surface texture measurement of a print media.

8. The method as in claim 7 further comprising determining the media type by combining the analysis of the surface texture data with a predicted media type to derive a final media type.

9. A method for determining a variance of a sensor in inkjet printers comprising:

reading a barcode of a print media;

identifying a media type using a table that correlates barcode to media type;

maintaining a printer carriage at a stationary position;

illuminating a media with a light source that varies an intensity of the light between at least a first and second intensity, in which the second intensity is different from the first intensity;

obtaining diffuse and specular reflectance data from light reflected off the media by measuring a signal from a photo-detector during the illumination;

comparing the diffuse and specular data to stored values corresponding to the media type identified by the barcode to determine a variation of the sensor response for forming a correction factor; and using the correction factor to calibrate the diffuse and specular signals of the sensor.

10. A method for determining a variance of a sensor in inkjet printers comprising:

maintaining a printer carriage at a stationary position;

illuminating a media patch with known characteristics with a light source that varies an intensity of the light between at least a first and second intensity, in which the second intensity is different from the first intensity; wherein the first and second intensities are provided by the same light source;

obtaining specular and diffuse reflectance data from light reflected off the media patch by measuring a signal from a photo-detector during the illumination;

comparing the specular and diffuse data to stored values to determine a variation of the sensor response for forming correction factors; and using the correction factors to calibrate specular and diffuse signals of the sensor of the inkjet printer.

11. The method as in claim 10 comprising:

maintaining the printer carriage at the stationary position;

illuminating a media with a light source that varies an intensity of the light between at least a first and second intensity, in which the second intensity is different from the first intensity; wherein the first and second intensities are provided by the same light source;

obtaining calibrated specular and diffuse reflectance data from light reflected off the media by measuring a signal from a photo-detector during the illumination;

comparing the specular and diffuse data to stored values for different media types to determine a first media type.

12. The method as in claim 11 further comprising using the calibrated specular signal to execute an optical surface texture measurement of a print media.

13. The method as in claim 12 further comprising determining a second media type by analyzing the surface texture data.

14. The method as in claim 13 further comprising determining a final media type by following a decision tree algorithm that uses the first and second media type as input.

15. A method for determining a variance of a sensor in inkjet printers comprising:

maintaining a printer carriage at a stationary position;

illuminating a media patch of known characteristics with a light source that varies an intensity of the light between at least a first and second intensity, in which the second intensity is different from the first intensity; wherein the first and second intensities are provided by the same light source;

obtaining at least specular reflectance data from light reflected off the print media by measuring a signal from a photo-detector during the illumination; and comparing the specular data to stored values to determine a variation of the sensor response for forming a correction factor.

* * * * *